US005095961A

United States Patent [19]

Nakagawa

[11] Patent Number: 5,095,961

[45] Date of Patent: Mar. 17, 1992

[54] POWDER FEEDING DEVICE

[75] Inventor: Mitsuhiko Nakagawa, Itami, Japan

[73] Assignee: Sumitomo Electric Industries, Ltd., Osaka, Japan

[21] Appl. No.: 642,126

[22] Filed: Jan. 14, 1991

Related U.S. Application Data

[63] Continuation-in-part of Ser. No. 361,859, Jun. 5, 1989, abandoned.

[30] Foreign Application Priority Data

Jun. 17, 1988 [JP] Japan ..... 63-81024[U]

[51] Int. Cl.[5] ..... B67C 3/26

[52] U.S. Cl. ..... 141/275; 222/200; 222/447; 222/561

[58] Field of Search ..... 141/275

[56] References Cited

U.S. PATENT DOCUMENTS

| | | | |
|---|---|---|---|
| 29,937 | 9/1860 | Hines | 222/447 |
| 241,924 | 5/1881 | Buswell | 222/561 |
| 1,443,181 | 1/1923 | Hill, Sr. | 222/502 |
| 3,333,537 | 2/1964 | Proskauer | 222/200 X |
| 3,722,747 | 3/1973 | Petit | 222/200 X |
| 4,066,107 | 1/1978 | Karp et al. | 222/447 |
| 4,776,493 | 10/1988 | Tegel | 222/559 |

*Primary Examiner*—Robert P. Olszewski
*Assistant Examiner*—Steven M. Reiss
*Attorney, Agent, or Firm*—Wenderoth, Lind & Ponack

[57] ABSTRACT

A feeding device having a hopper for storing and feeding a material having a low flowability such as powder, fibers or a mixture thereof. Comb-shaped obstruction plates are provided at the outlet side of the hopper so as to be slidable toward and away from each other to close and open the outlet opening. The slidable obstruction plates may be replaced with a single non-slidable plate having a plurality of openings. When in a stationary state, the material is prevented from dropping due to friction between it and the obstruction plate. The hopper may have its outlet opening elongated in one direction, with the area of the outlet opening being larger than half the area of the inlet opening.

31 Claims, 5 Drawing Sheets

POWDER FEEDING DEVICE

This application is a continuation-in-part of now abandoned application, Ser. No. 07/361,859, filed on June 5, 1989.

The present invention relates to a powder feeding device for temporarily storing in a hopper a material having a poor flowability such as powder, short fiber and a mixture thereof and feeding the material continuously or intermittently little by little while keeping the homogeneity of the material.

When discharging the material in the hopper, it is necessary to control or restrict its flow rate. One known method therefor is to narrow the outlet opening of the hopper. Due to the orifice effect, this will minimize error in the feeding rate resulting from a delay in the response of a closing mechanism such as a shutter for closing the outlet opening. Another known method is to provide upper and lower shutters near the outlet opening of the hopper so that a weighing space will be formed therebetween. The shutters are adapted to move so that the upper shutters are opened when the lower shutters are closed and then the upper shutters are closed while the lower shutters are opened. Thus a predetermined amount of material is taken out of the hopper.

It is also a common practice to provide an agitator, a vibrator and/or a screw feeder to compensate for the poor flowability of the material. For example, a complicated hopper including an agitator is disclosed in Japanese Unexamined Patent Publication No. 48-72566 and Japanese Examined Patent Publication No. 57-3489.

If the outlet opening of the hopper is too narrow, a material having a low flowability tends to get stuck in the hopper in a bridge shape (the so-called bridge phenomenon) and is thus prevented from dropping through the opening.

Further, depending upon the angle of slope at the outlet as well as the angle of repose of the material, the material might be prohibited from sliding down through the outlet opening.

Various auxiliary devices such as a vibrator and a stirrer are used to solve this problem. When feeding a composite material containing a short fibers such as metallic fibers or soft fibers such as cotton and asbestos, or a plastering material including fibers, it is necessary to provide an auxiliary mechanism having a rather complicated structure. This will increase the cost of the feeding device, lower its reliability and make its maintenance more difficult.

If the powdery material contains fibers or relatively large particles, the shutters are difficult to open and close because a large slide resistance is applied to them.

Moreover, if the material contains granules or fibers having different diameters or different specific gravities, the material tends to separate into a plurality of layers by vibration or agitation. Thus the material taken out of the hopper tends to lose the uniformity or homogeneity.

Because of these problems, a feeding device without a hopper has heretofore been used to feed such a composite material containing short fibers. But in view of various advantages of a hopper such as easy temporary storage and excellent feed efficiency, it has been a long-felt need to provide a powder feeding device of a hopper type capable of feeding a material smoothly and precisely at a desired rate without losing the homogeneity of the material.

It is an object of the present invention to provide a powder feeding device which meets the abovesaid requirements.

In accordance with the present invention, there is provided a powder feeding device for feeding a material having a low flowability such as powder, granules, fibers and a mixture thereof, comprising a hopper having an inlet opening and an outlet opening for storing the material, obstruction means provided near the outlet opening of the hopper, and driving means for moving the obstruction means between an open position and a closed position, whereby stopping the material from dropping through the obstruction means by the friction between the material and the obstruction means when the obstruction means is in its closed position and discharging the material when it is in its open position.

In one of the embodiments, the distance between the adjacent teeth of the obstruction plates is shorter than a predetermined value (which is determined by the type and characteristics of the material) so that the material in the hopper will get stuck between the adjacent teeth owing to the bridge phenomenon and is prevented from dropping through the obstruction plates. This will eliminate the necessity of narrowing the outlet opening of the hopper.

The comb-shaped obstruction plates can be smoothly slid through even a material containing fibers without encountering any major resistance as with conventional plate-shaped shutters. Further, the slide resistance when opening and closing the obstruction plates will decrease remarkably by vibrating the obstruction plates or by rotating their teeth.

Means for opening and closing the outlet of the hopper may be provided under the obstruction plates to form a weighing space therebetween. This will allow the material in the hopper to be taken out intermittently by any desired amount.

The powder feeding device in another embodiment has an obstruction plate formed with slitted or meshed openings. This obstruction plate prevents the material from dropping therethrough on the same principle as the comb-shaped obstruction plates. But while it is being vibrated or turned, the reposed state of the material will be broken, allowing the material to drop through the openings in the plates In this embodiment, the material can be discharged either continuously or intermittently by controlling the operating cycle of the obstruction plate.

In a further embodiment, the outlet opening of the hopper has a sufficient width and thus a sufficient area This will allow smooth feed of the material By increasing the width, the area of the outlet opening can be increased while keeping its depth to a minimum Thus, the material-supporting means can be turned to its closed position smoothly without encountering any major resistance The material dropped onto the conveyor may be fed onto a weighing scale to subdivide the material precisely as desired.

In any of the embodiments, the hopper can have a large outlet so as to allow the material can be smoothly discharged without the necessity of vibrating or agitating This will prevent of material from becoming less homogeneous.

Further, in order to minimize the impact of dropping the material into the hopper, comb-shaped projections may be provided on the inner wall of the hopper at different levels so as to be opened and closed alternately with respect to each other.

Other features and objects of the present invention will become apparent from the following description taken with reference to the accompanying drawings, in which.

Figure 1A:
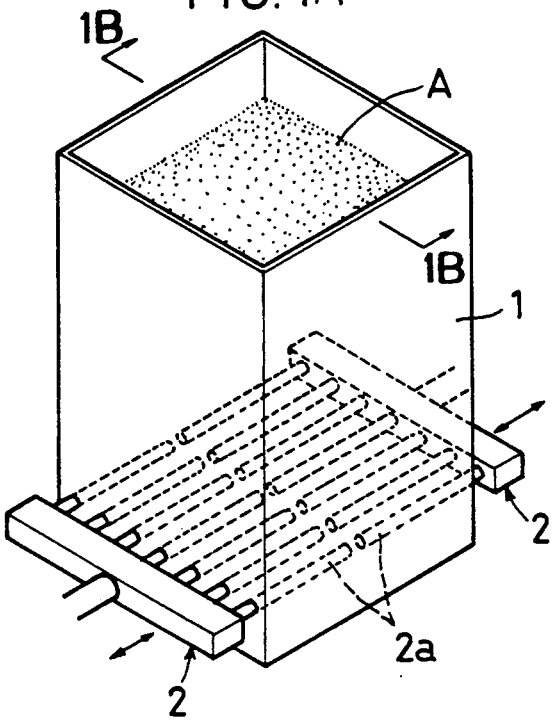
FIG. 1A is a perspective view of the first embodiment of the present invention.
Figure 1B:
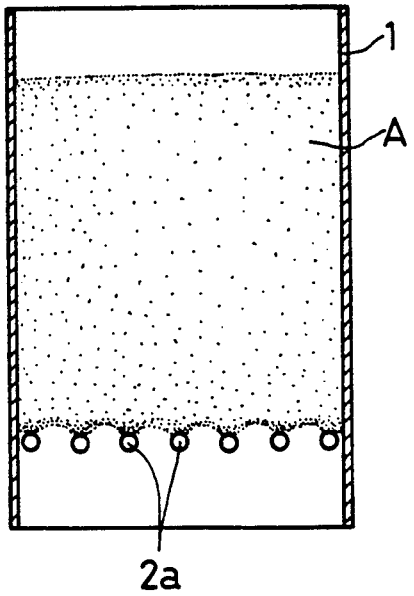
FIG. 1B is a sectional view of the same taken along line 1B—1B of FIG. 1A.

FIGS. 1A and 1B show the first embodiment of the present invention which comprises a hopper 1 and a pair of comb-shaped obstruction plates 2 provided at the bottom of the hopper and each having a plurality of teeth 2*a* protruding toward each other and adapted to slide toward and away from each other to close and open the bottom of the hopper. When the obstruction plates 2 are in the closed position, a material A having a poor flowability such as powder, short fibers or a mixture thereof is prevented from dropping from the hopper due to the friction with the obstruction plates 2. When they are in their open position, a predetermined amount of material can be taken out of the hopper.

It is preferable to provide this embodiment with a means for giving micro-vibrations to the obstruction plates 2 and/or a means for revolving their teeth 2*a* about their own axes for purposes to be described later.

Further, means for opening and closing the bottom of the hopper should preferably be provided at a predetermined distance below the obstruction plates so that it will be closed when the obstruction plates are opened, and vice versa.

Figure 4A:
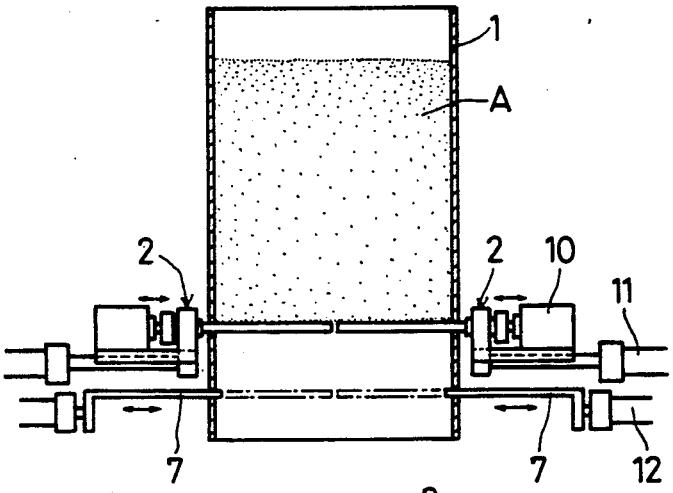
FIG. 4A is a sectional view showing the details of the first embodiment.
Figure 4B:
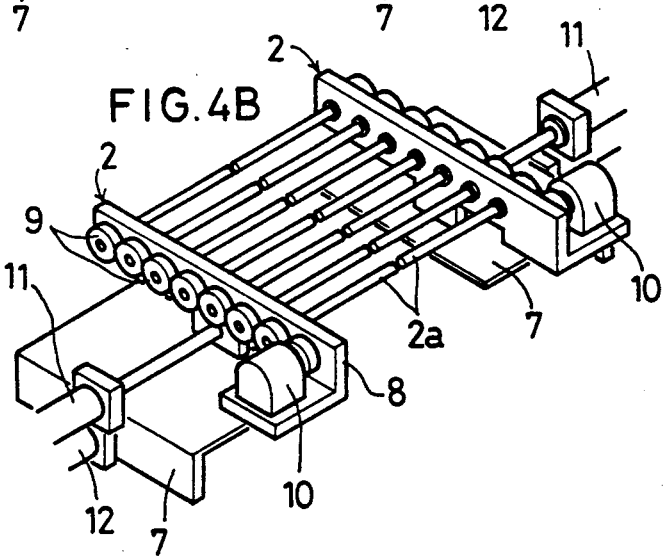
FIG. 4B is a perspective view of the same with the hopper removed.

FIGS. 4A and 4B show the details of the first embodiment. Numeral 7 designates a shutter or means for opening and closing the bottom of the hopper. The obstruction plates 2 have their teeth 2*a* rotatably supported by a frame 8. Friction rollers 9 for torque transmission are mounted on the respective teeth 2*a* at their outer ends. Each roller 9 is in frictional engagement with the adjacent ones so that all the teeth 2*a* can revolve all at once when a turning torque is applied to one of the rollers 9 from a motor 10. Each tooth 2*a* has its inner end slightly out of alignment with its outer end so that the inner end will rotate rather shakily. This will facilitate the insertion of the teeth 2*a* into the material A.

Each tooth 2*a* may have a diamond-shaped or elliptical section so that the obstruction plates 2 could be opened and closed merely by turning their teeth 2*a* without the necessity of sliding the plates 2.

Driving means such as cylinders 11 and 12 are used to laterally slide the obstruction plates 2 and the shutters 7, respectively, to open and close the bottom of the hopper. The cylinders 12 are adapted to open the shutters 7 after the obstruction plates 2 have been closed by the cylinders 11 and to close them before the obstruction plates 2 are opened. Little closing resistance will act on the shutters 7 even if they are plate-shaped, because they are closed after a weighing space formed between the shutters 7 and the obstruction plates 2 has been emptied.

With this arrangement, any desired amount of material can be taken out of the hopper by adjusting the distance between the obstruction plates 2 and the shutters 7. Also, the discharge rate can be adjusted by controlling the sliding speed of the obstruction plates 2 and/or the shutters 7.

Figure 2:
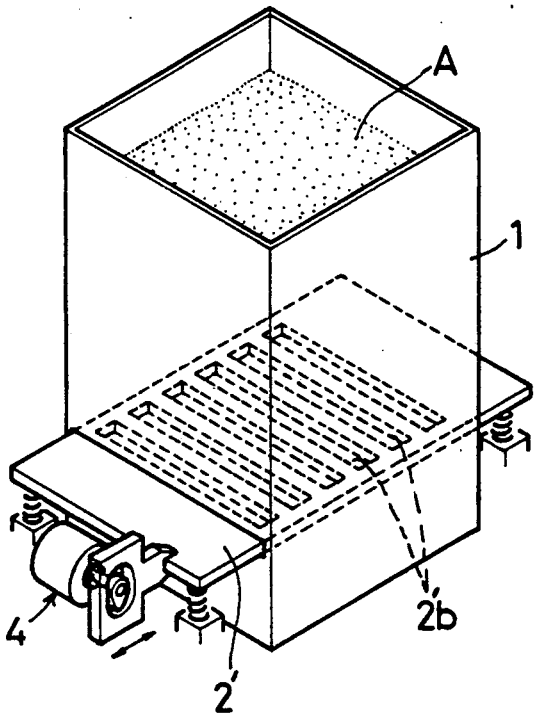
FIG. 2 is a perspective view of the second embodiment.

FIG. 2 shows the second embodiment which is provided at the outlet side of the hopper 1 with an obstruction plate 2' having slits or elongated holes 2'b. The obstruction plate 2' is adapted to be driven by a driving means 4. The material A will be prevented from dropping through the plate 2' due to the friction with the plate when it is in a stationary state and the material will drop therethrough when the plate is activated.

The plate 2' may adapted to be reciprocate in short horizontal strokes, vibrate slightly in a manner such that the plate does not touch the hopper 1, or rotated about its vertical axis (if the plate 2' is disc-shaped). The plate 2' specifically shown in the drawings is supported on springs and adapted to be reciprocated horizontally by the driving means 4 comprising a cam and a motor.

In this embodiment the discharge rate per unit time can be controlled by adjusting the size of the openings 2*b* and the degree of vibration, reciprocation or the speed of rotation of the obstruction plate 2'.

The obstruction plate 2' in this embodiment may comprise a pair of plates adapted to slide in opposite directions relative to each other to reliably discharge the material in the hopper.

Figure 3A:
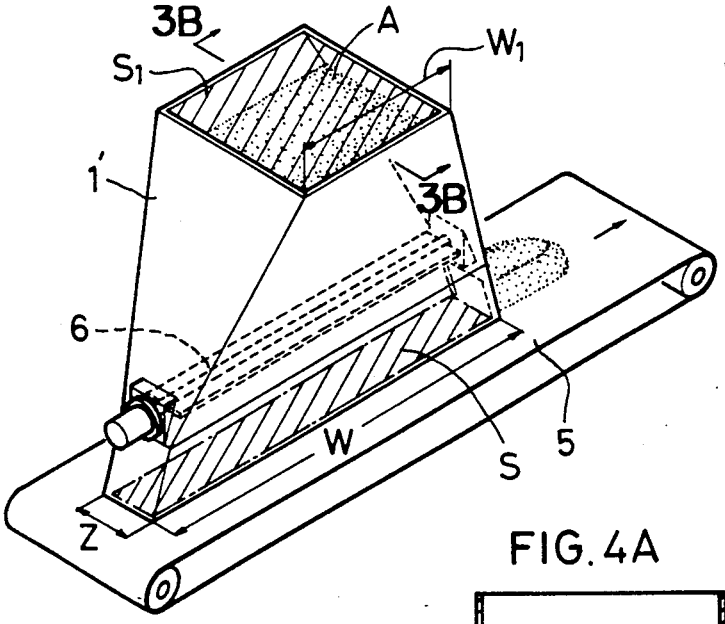
FIG. 3A is a perspective view of the third embodiment.
Figure 3B:
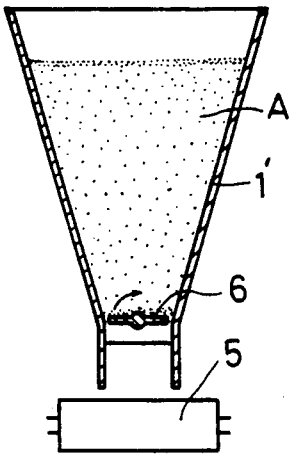
FIG. 3B is a sectional view taken along line 3B—3B of FIG. 3A.

FIGS. 3A and 3B show the third embodiment which comprises a hopper 1' having such a shape that the area S of the outlet opening is smaller than the area S1 of the inlet opening but larger than half the area S1. The outlet opening has a width W larger than the width W1 of the inlet opening. Under the hopper 1', a belt conveyor 5 is provided to transport the material A delivered from the hopper in the longitudinal direction of the hopper. Also, in the hopper, there is provided. Material-supporting means 6 for preventing the material from dropping after a predetermined amount of the material has been discharged.

Figure 5:
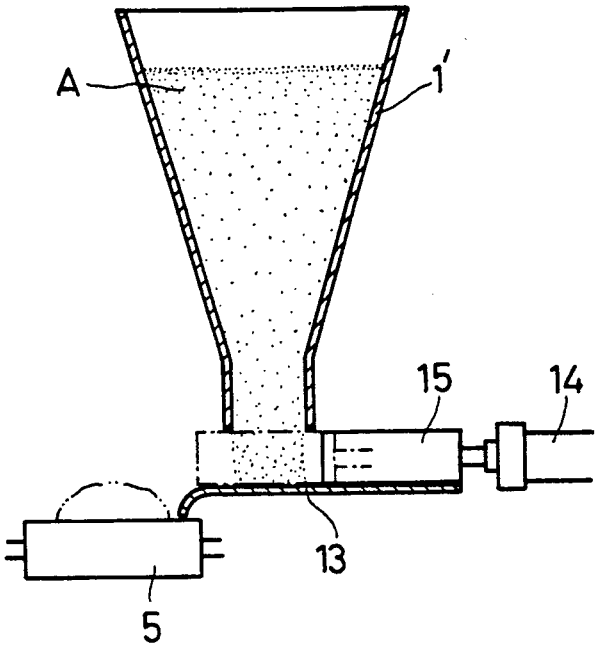
FIG. 5 is a schematic view of a modification of the third embodiment as viewed from the direction of travel of the conveyor.

FIG. 5 shows a modification of the third embodiment shown in FIGS. 3A and 3B. In the embodiment shown in FIG. 3, the conveyor 5 is arranged right under the hopper 1' and the material-supporting means 6 in the form of a narrow and rotatable shutter extends in the longitudinal direction of the hopper. In constrast, the device shown in FIG. 5 has a chute 13 located under the hopper to receive the material from the hopper 1' and a slider 15 urged by a cylinder actuator 14 to push the material on the chute 13 down onto the conveyor 5 and to simultaneously close the outlet opening of the hopper 1'. With the devices shown in FIGS. 3A and 3B and FIG. 5, the discharge rate of the material is controlled by adjusting the turning speed of means 6 or the sliding speed of the slider 15.

Figure 6:
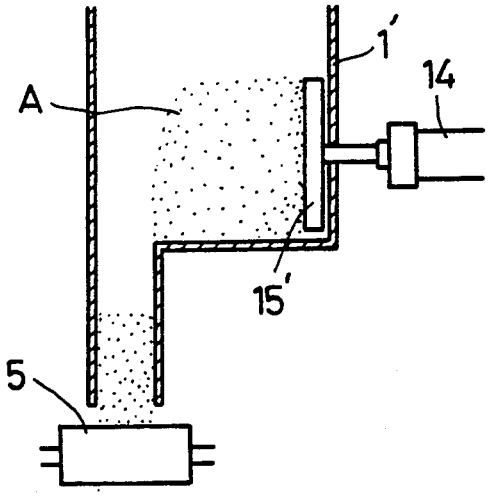
FIG. 6 is a schematic view of another modification of the third embodiment.

FIG. 6 shows a modification of the device of FIG. 5 in which a slider 15' is provided at the upper part of the hopper 1'. The material A on a horizontal wall of the hopper is pushed by the slider 15' to drop little by little onto the conveyor 5 at a desired rate.

In the above-described embodiments, the uniformity and homogeneity of the material A taken out of the hopper improve remarkably compared with a prior art device. The terms "uniformity" and "homogeneity" as used herein refer to the fact that the distances and arrangement between the particles of the material do not change even if the material moves.

Figure 7A:
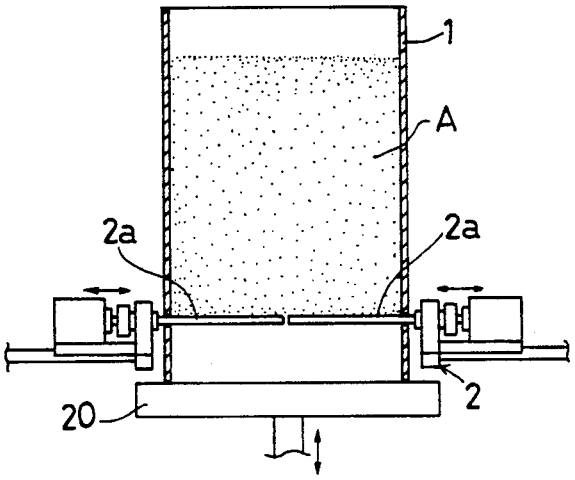
FIGS. 7A-7D are sectional views of another embodiment showing how it operates.

In the embodiment shown in FIG. 7A, the shutter 7 in FIG. 4A is replaced with a tray 20 having a flat top surface. In other points the structure is the same as in the embodiment of FIG. 4. The tray 20 is located under the hopper 1 and is vertically movable. When it is in its uppermost position, its top surface comes into contact with the bottom of the hopper 1, thus preventing the material A from leaking out of the hopper.

Figure 7B:
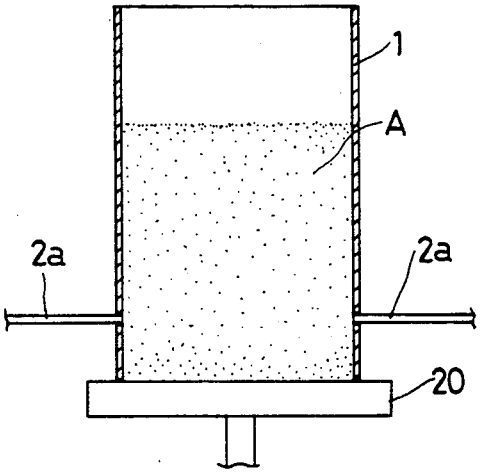
Figure 7C:
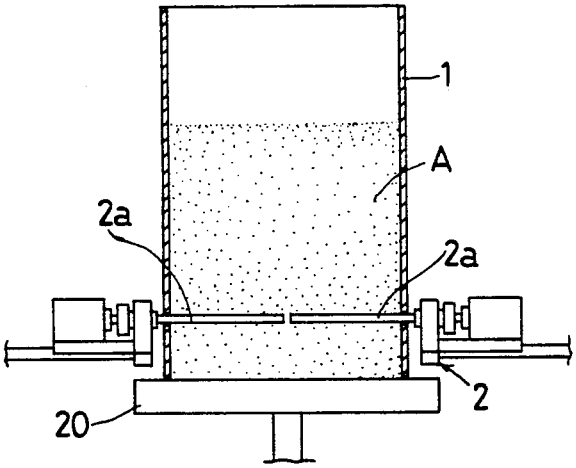
Figure 7D:
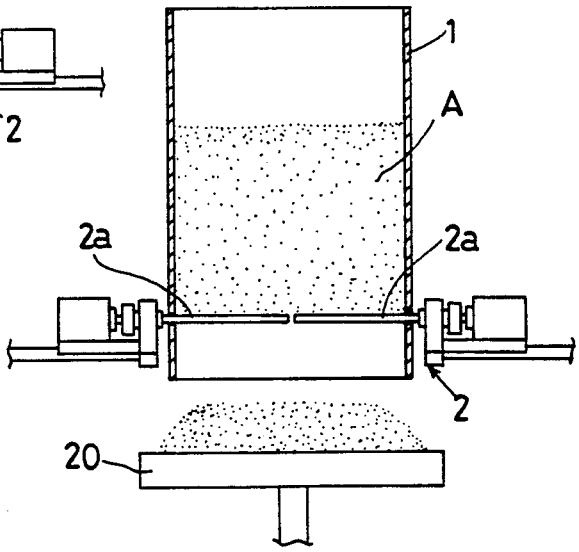

The operation of this embodiment will be described with reference to FIGS. 7A–7D. In the state of FIG. 7A, the obstruction plates 2 are closed and the tray 20 is in contact with the bottom of the hopper. The material in the hopper 1 is supported on the obstruction plates 2. Then the obstruction plates 2 are slid open, the material will drop onto the tray 20, such that the entire weight of the material bears on the tray 20 (FIG. 7B). When the obstruction plates 2 are slid open, the material will not lose its uniformity and homogeneity because the frictional resistance between the comb-shaped obstruction plates 2 and the material is extremely small compared with the frictional resistance between the shutters 6 or 7 (as shown in FIGS. 3B and 4A) and the material. By closing the obstruction plates 2 (FIG. 7C) and lowering the tray 20 or raising the hopper, a predetermined amount of material will be left on the tray 20 (FIG. 7D).

Figure 8:
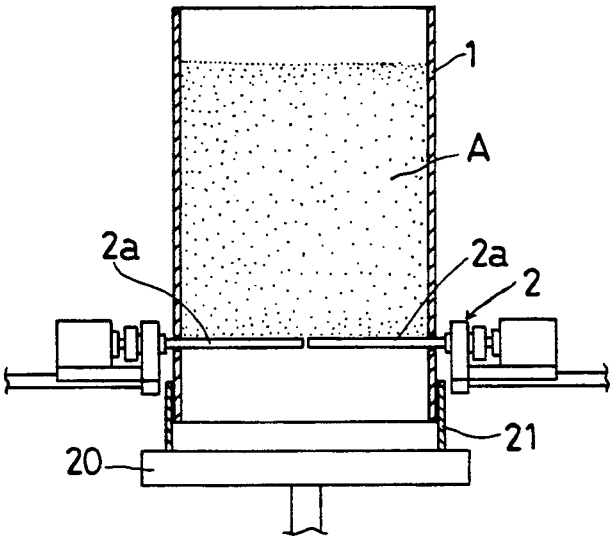
FIG. 8 is a sectional view of still another embodiment.

The amount of the material to be taken out on the tray 20 is determined by the distance between the obstruction plates 2 and the top surface of the trap when it is in its uppermost position. In the embodiment shown in FIG. 8, a slide member 21 is secured to the hopper 1 or the tray 20 so as to surround the lower part of hopper 1. With this arrangement, the above-mentioned distance and thus the amount of the material to be taken out can be adjusted freely.

Figure 9:
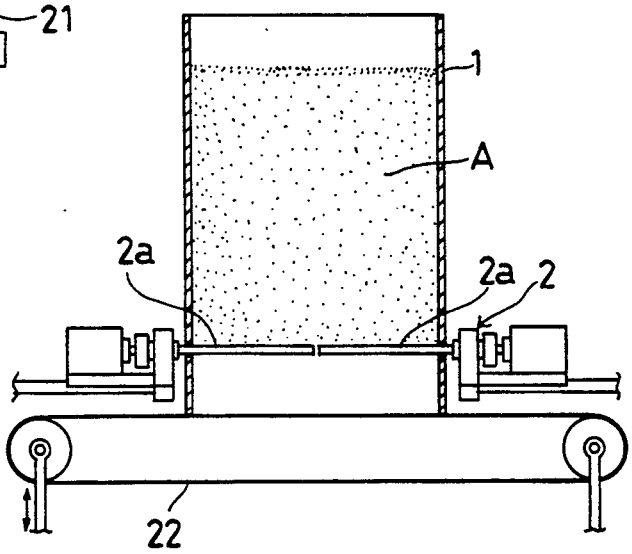
FIG. 9 is a sectional view of a further embodiment.

FIG. 9 shows another embodiment in which the tray 20 of FIG. 7A is replaced with a vertically movable belt conveyor 22. Otherwise this embodiment is the same in structure and function as the embodiment of FIG. 7A.

Figure 10:
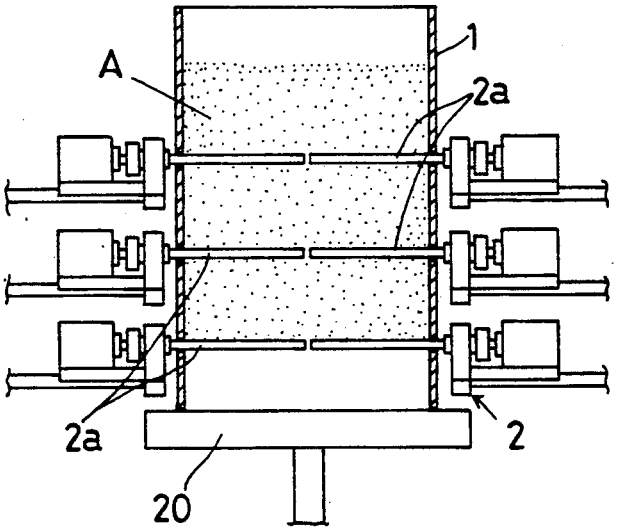
FIG. 10 is a sectional view of yet another embodiment.

In the above-described embodiments, since there are provided only a single pair of obstruction plates, the pressure acting on the lower part of the material in the hopper tends to increase with increase in the amount of material in the hopper. As a result, the weight per unit are may change, thus breaking the balance of mixture of the substances in the material. In order to solve this problem, in the embodiment shown in FIG. 10, a plurality of pairs of obstruction plates 2 (three in the embodiment) are provided at equal vertical spacings from each other. By opening and closing the respective pairs alternately, the lowermost pair of obstruction plates receives only the weight of the material present in the space defined by the lowermost pair and the pair directly thereover. Thus the pressure on the lower part of the material can be kept constant irrespective of the amount of the material in the hopper.

What is claimed is:

1. A material feeding device, for feeding a material having a low flowability, comprising:

a hopper, for storing the material, having substantially vertical sidewalls, an inlet opening and an outlet opening, said inlet opening having an area which is substantially equal to the area of said outlet opening;

obstruction means, selectively movable between a closed position and an open position, for preventing the material from flowing toward said outlet opening of said hopper beyond a particular location due to friction between the material and said obstruction means when said obstruction means is in said closed position, and for allowing the material to flow toward said outlet opening beyond said particular location when said obstruction means is in said open position;

driving means for moving said obstruction means between said closed position and said open position; and a collector means, having a substantially horizontal top surface, for receiving the material in said hopper, at least one of said collector means and said hopper being movable vertically relative to the other between a first position in which the material in said hopper is prevented from leaking out of said hopper and a second position in which said collector means and said hopper are spaced apart relative to said first position.

2. A material feeding device as recited in claim 1, wherein said obstruction means comprises a pair of comb-shaped members which are movable toward and away from one another; and said driving means comprises means for selectively moving said comb-shaped members toward and away from one another.

3. A material feeding device as recited in claim 2, wherein said comb-shaped members include elongated substantially horizontally disposed teeth.

4. A material feeding device as recited in claim 2, wherein said comb-shaped members include elongated teeth having longitudinal axes; and said driving means further comprises means for rotating said teeth of said comb-shaped members about their longitudinal axes.

5. A material feeding device as recited in claim 4, wherein said teeth include inner ends and outer ends, and said inner ends are slightly misaligned relative to said inner ends such that when said teeth are rotated by said driving means, said inner ends rotate eccentrically.

6. A material feeding device as recited in claim 2 further comprising shutter means, comprising shutters positioned below said obstruction means and being movable between an open position and a closed position, for preventing the material from flowing through said outlet opening when said obstruction means is in said open position and for allowing the material to flow through said outlet opening when said obstruction means is in said closed position.

7. A material feeding device as recited in claim 1, wherein said obstruction means defines a first obstruction means, selectively movable between a closed position and an open position, for preventing the material from flowing toward said outlet opening of said hopper beyond a first location due to friction between the material and said first obstruction means when said first obstruction means is in closed position, and for allowing the material to flow toward said outlet opening beyond said first location when said first obstruction means is in said opening position; and at least one additional obstruction means, which is selectively movable between a closed position and an open position, is provided for preventing the material from flowing toward said outlet opening of said hopper beyond at least one additional location, respectively, due to friction between the material and said at least one additional obstruction means when said at least one additional obstruction means is in said closed position, and for allowing the material to flow toward said outlet beyond said at least one additional position, respectively, when said at least one additional obstruction means is in said open position.

8. A material feeding device as recited in claim 7, wherein said first obstruction means and said at least one additional obstruction means are vertically spaced apart from one another.

9. A material feeding device as recited in claim 1, further comprising shutter means, comprising shutters positioned below said obstruction means and being movable between an open position and a closed position, for preventing the material from flowing through said outlet opening when said obstruction means is in said open position and for allowing the material to flow through said outlet opening when said obstruction means is in said closed position.

10. A material feeding device as recited in claim 1, wherein said collector means comprises a conveyor belt.

11. A material feeding device as recited in claim 1, wherein said hopper is fixed in position and said collector means is vertically movable.

12. A material feeding device as recited in claim 1, wherein said collector means is fixed in position and said hopper is vertically movable.

13. A material feeding device for feeding a material having a low flowability, comprising:

a hopper, for storing the material, having substantially vertical sidewalls, an inlet opening and an outlet opening, said inlet opening having an area which is substantially equal to the area of said outlet opening;

obstruction means, comprising a pair of comb-shaped members selectively changeable between a first state and a second state, for preventing the material from flowing toward said outlet opening of said hopper beyond a particular location due to friction between the material and said obstruction means when said obstruction means is in said first state, and for allowing the material to flow toward said outlet opening beyond said particular location when said obstruction means is in said second state;

driving means for changing said obstruction means between said first state and said second state; and a collector means, having a substantially horizontal top surface, for receiving the material in said hopper, at least one of said collector means and said hopper being movable vertically relative to the other between a first position in which the material in said hopper is prevented from leaking out of said hopper and a second position in which said collector means and said hopper are spaced apart relative to said first position.

14. A material feeding device as recited in claim 13, wherein said driving means comprises means for selectively moving said comb-shaped members toward and away from one another.

15. A material feeding device as recited in claim 14 wherein said comb-shaped members include elongated teeth having longitudinal axes; and said driving means further comprises means for rotating said teeth of said comb-shaped members about their longitudinal axes.

16. A material feeding device as recited in claim 15, wherein said teeth include inner ends and outer ends, and said inner ends are slightly misaligned relative to said inner ends such that when said teeth are rotated by said driving means, said inner ends rotate eccentrically.

17. A material feeding device as recited in claim 13, wherein said obstruction means defines a first obstruction means, selectively movable between a first state and a second state, for preventing the material from flowing toward said outlet opening of said hopper beyond a first location due to friction between the material and said first obstruction means when said first obstruction means is in said first state, and for allowing the material to flow toward said outlet opening beyond said first location when said first obstruction means is in said opening position; and at least one additional obstruction means, which is selectively vertically movable between a first state and a second state, is provided for preventing the material from flowing toward said outlet opening of said hopper beyond at least one additional location, respectively, due to friction between the material and said at least one additional obstruction means when said at least one additional obstruction means is in said first state, and for allowing the material to flow toward said outlet beyond said at least one additional position, respectively, when said at least one additional obstruction means is in said second state.

18. A material feeding device as recited in claim 17, wherein said first obstruction means and said at least one additional obstruction means are vertically spaced apart from one another.

19. A material feeding device as recited in claim 13, wherein said comb-shaped members include elongated substantially horizontally disposed teeth.

20. A material feeding device as recited in claim 13, further comprising shutter means, comprising shutters positioned below said obstruction means and being movable between an open position and a closed position, for preventing the material from flowing through said outlet opening when said obstruction means is in said second state and for allowing the material to flow through said outlet opening when said obstruction means is in said first state.

21. A material feeding device as recited in claim 13, wherein said collector means comprises a conveyor belt.

22. A material feeding device as recited in claim 13, wherein said hopper is fixed in position and said collector means is vertically movable.

23. A material feeding device as recited in claim 13, wherein said collector means is fixed in position and said hopper is vertically movable.

24. A material feeding device, for feeding a material having a low flowability, comprising:

a hopper, for storing the material, having substantially vertical sidewalls, an inlet opening and an outlet opening, said inlet opening having an area which is substantially equal to the area of said outlet opening;

obstruction means, comprising a plate having a plurality of elongated holes formed therethrough and being selectively changeable between a first state and a second state, for preventing the material from flowing toward said outlet opening of said hopper beyond a particular location due to friction between the material and said obstruction means when said obstruction means is in said first state, and for allowing the material to flow toward said outlet opening beyond said particular location when said obstruction means is in said second state;

driving means for causing said obstruction means to be in said second state by reciprocatingly driving said plate; and a collector means, having a substantially horizontal top surface, for receiving the material in said hopper, at least one of said collector means and said hopper being movable vertically relative to the other between a first position in which the material in said hopper is prevented from leaking out of said hopper and a second position in which said collector means and said hopper are spaced apart relative to said first position.

25. A material feeding device as recited in claim 24, wherein said plate is substantially horizontal.

26. A material feeding device as recited in claim 24, further comprising shutter means, comprising shutters positioned below said obstruction means and being movable between an open position and a closed position, for preventing the material from flowing through said outlet opening when said obstruction means is in said second state and for allowing the material to flow through said outlet opening when said obstruction means is in said first state.

27. A material feeding device as recited in claim 24, wherein said collector means comprises a conveyor belt.

28. A material feeding device as recited in claim 24, wherein said obstruction means defines a first obstruction means, selectively movable between a first state and a second state, for preventing the material from flowing toward said outlet opening of said hopper beyond a first location due to friction between the material and said first obstruction means when said first obstruction means is in said first state, and for allowing the material to flow toward said outlet opening beyond said first location when said first obstruction means is in said opening position; and at least one additional obstruction means, which is selectively vertically movable between a first state and a second state, is provided for preventing the material from flowing toward said outlet opening of said hopper beyond at least one additional location, respectively, due to friction between the material and said at least one additional obstruction means when said at least one additional obstruction means is in said first state, and for allowing the material to flow toward said outlet beyond said at least one additional position, respectively, when said at least one additional obstruction means is in said second state.

29. A material feeding device as recited in claim 28, wherein said first obstruction means and said at least one additional obstruction means are vertically spaced apart from one another.

30. A material feeding device as recited in claim 24, wherein said hopper is fixed in position and said collector means is vertically movable.

31. A material feeding device as recited in claim 24, wherein said collector means is fixed in position and said hopper is vertically movable.

* * * * *